US008747090B2

(12) United States Patent
Sato et al.

(10) Patent No.: US 8,747,090 B2
(45) Date of Patent: Jun. 10, 2014

(54) ROTARY COMPRESSOR WITH IMPROVED OIL RETENTION

(75) Inventors: Kazuya Sato, Oizumi-machi (JP); Takashi Sato, Kumagaya (JP)

(73) Assignee: SANYO Electric Co., Ltd., Moriguchi-shi (JP)

( * ) Notice: Subject to any disclaimer, the term of this patent is extended or adjusted under 35 U.S.C. 154(b) by 679 days.

(21) Appl. No.: 13/049,505

(22) Filed: Mar. 16, 2011

(65) Prior Publication Data

US 2011/0236245 A1 Sep. 29, 2011

(30) Foreign Application Priority Data

Mar. 25, 2010 (JP) ..... 2010-069778

(51) Int. Cl.
*F04C 18/356* (2006.01)
*F04C 29/12* (2006.01)
*F04C 23/00* (2006.01)

(52) U.S. Cl.
CPC ..... *F04C 29/12* (2013.01); *F04C 2250/102* (2013.01); *F04C 18/3564* (2013.01); *F04C 23/001* (2013.01); *Y10S 418/01* (2013.01)
USPC ..... 418/150; 418/DIG. 1

(58) Field of Classification Search
CPC .. F04C 29/12; F04C 2250/102; F04C 18/356; F04C 18/3564; F04C 23/008; F04C 23/001
USPC ..... 418/150, 83, 88, 94, DIG. 1
See application file for complete search history.

(56) References Cited

U.S. PATENT DOCUMENTS 1,929,999 A * 10/1933 Wilson ..... 418/88
2011/0243779 A1* 10/2011 Masuda ..... 418/67

FOREIGN PATENT DOCUMENTS

JP 61178590 A * 8/1986 ..... F04C 23/02
JP 61-171892 U 10/1986
JP 05195975 A * 8/1993 ..... F04C 29/02
JP 2006-336481 A 12/2006

* cited by examiner

*Primary Examiner* — Mary A Davis
(74) *Attorney, Agent, or Firm* — Westerman, Hattori, Daniels & Adrian, LLP

(57) ABSTRACT

A rotary compressor includes: a driving element which is provided inside a sealed container; and a rotary compression element which is provided inside the sealed container so as to be located below the driving element. A refrigerant discharge pipe is inserted from a side surface of the sealed container above the driving element into the sealed container, and is opened in the horizontal direction. A refrigerant compressed by the rotary compression element is discharged from a discharge hole into the sealed container, and is discharged from the refrigerant discharge pipe to the outside of the sealed container. The position of the discharge hole is set to a position below an area A1 on the opposite side of the opening direction of the refrigerant discharge pipe from a line L1 passing an opening surface of the refrigerant discharge pipe and perpendicular to the opening direction of the refrigerant discharge pipe.

12 Claims, 7 Drawing Sheets

ROTARY COMPRESSOR WITH IMPROVED OIL RETENTION

BACKGROUND OF THE INVENTION

The present invention relates to a rotary compressor that includes a driving element and a rotary compression element inside a sealed container.

Both currently and in the past, a vertical rotary compressor has a configuration shown in FIG. 6, where a driving element 114 is disposed at an upper space inside a vertical cylindrical sealed container 112, and a rotary compression element 118 including a first rotary compression element 132 and a second rotary compression element 134 driven by a rotary shaft 116 of the driving element 114 is disposed below the driving element 114. The rotary compressor 110 is a so-called internal high-pressure-type multi-stage compressing compressor in which a refrigerant gas is compressed by the first rotary compression element 132, is further compressed by the second rotary compression element 134, and then is discharged into the sealed container 112.

The sealed container 112 includes a container body 112A which accommodates the driving element 114 and the rotary compression element 118, and a substantially bowl-shaped end cap 112B (a cover body) which blocks an upper opening of the container body 112A, where the bottom portion thereof is formed as a sump 119. A terminal 120 is attached to the upper surface of the end cap 112B to supply power to the driving element 114.

The driving element 114 includes a stator 122 and a rotor 124 which is inserted into the stator 122 with a slight gap therebetween, and the rotor 124 is fixed to the rotary shaft 116 that extends in the vertical direction along the center of the sealed container 112.

The rotary compression element 118 has a structure in which the first and second rotary compression elements are disposed with an intermediate partition plate 136 interposed therebetween, the first rotary compression element 132 (first stage) is disposed at the opposite side of the driving element 114, and the second rotary compression element 134 (second stage) is disposed at the side of the driving element 114 inside the sealed container 112.

Then, a first support member 151 (a lower support member) serving as a support member is provided to block one (lower) opening of a first cylinder 141 (a lower cylinder) constituting the first rotary compression element 132, and includes a bearing 151A of the rotary shaft 116. A discharge muffling chamber 157 is formed in a manner such that the (lower) surface of the first support member 151 on the opposite side of the first cylinder 141 is recessed, and the recessed portion is blocked by a first cover 159 (a lower cover).

Further, a second support member 152 (an upper support member) is formed to block an upper opening of a second cylinder 142 constituting the second rotary compression element 134, and includes a bearing 152A of the rotary shaft 116. A discharge muffling chamber 158 is formed in a manner such that the (upper) surface of the second support member 152 on the opposite side of the second cylinder 142 is recessed, and the recessed portion is blocked by a second cover 160 (an upper cover). The second cover 160 is provided with a discharge hole 165 which allows the discharge muffling chamber 158 and the interior of the sealed container 112 to communicate with each other.

On the other hand, in the side surface of the container body 112A of the sealed container 112, sleeves 193 and 195 are respectively fixed to a position corresponding to the upper side of the driving element 114 of the first cylinder 141 and a position corresponding to a suction side of the first cylinder 141. One end of a refrigerant introduction pipe 194 is connected to the interior of the sleeve 193 to introduce a refrigerant gas into the first cylinder 141. Further, the refrigerant discharge pipe 196 is inserted and connected to the interior of the sleeve 195, the end portion of the refrigerant discharge pipe 196 is opened to the interior of the sealed container 112, and the refrigerant discharge pipe communicates with the interior of the sealed container 112.

Then, the refrigerant gas is suctioned from a suction port (not shown) to a low pressure side of the first rotary compression element 132, is subjected to a first-stage compression to receive a medium pressure, and is discharged to the discharge muffling chamber 157 from the high pressure side of the first rotary compression element 132. The refrigerant gas having a medium pressure and discharged to the discharge muffling chamber 157 is suctioned to the low pressure side of the second rotary compression element 134, is subjected to a second-stage compression to become a high-temperature and high-pressure refrigerant gas, enters the discharge muffling chamber 158, and is discharged upward from the discharge hole 165 of the second cover 160. The discharged high-temperature and high-pressure refrigerant gas moves to the upper side of the sealed container 112 via a gap in the driving element 114, and is discharged from the refrigerant discharge pipe 196 connected to the upper side of the sealed container 112 to the outside of the rotary compressor 110.

However, in the existing internal high-pressure-type multi-stage compressing rotary compressor 110, oil is dissolved in the refrigerant gas compressed by the second rotary compression element 134 and discharged from the discharge hole 165. The refrigerant gas with oil dissolved therein flies in the rotation direction of the rotary shaft 116 due to the inertia accompanying the rotation of the driving element 114. The discharged refrigerant gas and oil move upward via a gap between the stator 122 and the rotor 124, the interior of the rotor 124, or a gap between the sealed container 112 and the stator 122, and arrive at the upper side of the driving element 114. Then, the refrigerant gas and oil collide with the inner surface of the end cap so that some of it flies or adhere thereto.

Then, the oil inside the refrigerant is separated through the passage or the collision, the separated oil adheres to the inner surface of the sealed container 112, and the oil flows down to the lower sump 119 along the inner surface of the sealed container. However, a part of the oil moves in a floating state in the space above the driving element 114, and flows from the opening into the refrigerant discharge pipe 196, so that the oil exits the sealed container 112. In this case, the amount of refrigerant moving upward through the driving element 114 is smallest at the center of the sealed container 112 with the rotary shaft 116. For this reason, in the past, as shown in FIG. 7, the refrigerant discharge pipe 196 was opened in the horizontal direction (opened in the direction perpendicular to the sealed container 112), but the amount of oil exiting the sealed container 112 was not small.

Then, when the oil exits the sealed container during the refrigerating cycle, the amount of the oil inside the sealed container 112 is not sufficient, so that the circulation of the refrigerant is degraded. In particular, in recent years, in order to improve the performance of the rotary compressor 110, the refrigerant discharge pipe 196 has been set to have a larger diameter than that of the related art. Accordingly, the oil may easily exit the sealed container 112 through the refrigerant discharge pipe 196.

Therefore, there is disclosed a structure in which an annular shielding plate is provided at an upper portion of a stator of a motor inside a sealed container, a refrigerant discharge pipe is formed in a bent shape to separate oil dissolved in a refrigerant gas from the interior of the sealed container, and only the refrigerant gas is discharged from the sealed container, so that the amount of the oil exiting the refrigerant discharge pipe is reduced (for example, refer to Japanese Patent Application Laid-Open No. 2006-336481 (Patent Document 1)).

However, when the structure shown in Patent Document 1 is adopted in order to reduce a problem in which the oil exits the refrigerant discharge pipe, a problem arises in that the structure becomes complicated.

Therefore, when only the front end of the refrigerant discharge pipe is subjected to drawing in order to be thinned, the problem of the oil exiting the refrigerant discharge pipe may be reduced. However, a problem arises in that a processing cost increases due to the drawing performed on the front end of the refrigerant discharge pipe.

SUMMARY OF THE INVENTION

The invention is made to solve the above-described problems, and an object thereof is to provide a rotary compressor capable of reducing oil exiting a refrigerant discharge pipe by regulating positions of a discharge hole and an opening of the refrigerant discharge pipe to be predetermined positions.

In order to solve the above-described problems, according to the rotary compressor of a first aspect of the invention, there is provided a rotary compressor including: a driving element which is provided inside a sealed container; and a rotary compression element which is provided inside the sealed container so as to be located below the driving element and to be driven by a rotary shaft of the driving element, wherein a refrigerant discharge pipe is inserted from a side surface of the sealed container above the driving element into the sealed container, and is opened in the horizontal direction, wherein a refrigerant compressed by the rotary compression element is discharged from a discharge hole into the sealed container, and is discharged from the refrigerant discharge pipe to the outside of the sealed container, and wherein the position of the discharge hole is set to a position below an area A1 on the opposite side of the opening direction of the refrigerant discharge pipe from a line L1 passing an opening surface of the refrigerant discharge pipe and perpendicular to the opening direction of the refrigerant discharge pipe.

Further, according to the rotary compressor of a second aspect of the invention, in the above-described rotary compressor, when a range where oil inside the refrigerant discharged from the discharge hole and moving upward through the driving element flies or adheres to an inner surface of an end cap of the sealed container due to the inertia accompanying the rotation of the rotary compression element is denoted by A2, the position of the discharge hole is set to a position below the area A1 of a portion excluding the range A2 from the line L1 of a portion perpendicular to the opening direction of the refrigerant discharge pipe at the opposite side of the rotation direction of the rotary shaft.

Further, according to the rotary compressor of a third aspect of the invention, there is provided a rotary compressor including: a driving element which is provided inside a sealed container; and a rotary compression element which is provided inside the sealed container so as to be located below the driving element and to be driven by a rotary shaft of the driving element, wherein a refrigerant discharge pipe is inserted from a side surface of the sealed container above the driving element into the sealed container, and is opened in the horizontal direction, wherein a refrigerant compressed by the rotary compression element is discharged from a discharge hole into the sealed container, and is discharged from the refrigerant discharge pipe to the outside of the sealed container, and wherein the position of the discharge hole is set to a position below an area A3 interposed between a line L2 passing an opening surface of the refrigerant discharge pipe and perpendicular to the opening direction of the refrigerant discharge pipe at the side of the rotation direction of the rotary shaft and a line L3 obtained by rotating the line L2 about the opening center of the refrigerant discharge pipe by 90° in the rotation direction of the rotary shaft.

Further, according to the rotary compressor of a fourth aspect of the invention, in the rotary compressor of any one of the aspects, the opening center of the refrigerant discharge pipe is located at the center portion in the horizontal direction of the sealed container where the axis of the rotary shaft is located.

Furthermore, according to the rotary compressor of a fifth aspect of the invention, the rotary compressor according to any one of the aspects further includes: the first and second rotary compression elements which are driven by the driving element, wherein the refrigerant compressed by the first rotary compression element is compressed by the second rotary compression element, and is discharged from the discharge hole to the sealed container.

Furthermore, according to the rotary compressor of a sixth aspect of the invention, in the rotary compressor of any one of the aspects, carbon dioxide is used as the refrigerant.

According to the first aspect of the invention, there is provided a rotary compressor including: a driving element which is provided inside a sealed container; and a rotary compression element which is provided inside the sealed container so as to be located below the driving element and to be driven by a rotary shaft of the driving element, wherein a refrigerant discharge pipe is inserted from a side surface of the sealed container above the driving element into the sealed container, and is opened in the horizontal direction, wherein a refrigerant compressed by the rotary compression element is discharged from a discharge hole into the sealed container, and is discharged from the refrigerant discharge pipe to the outside of the sealed container, and wherein the position of the discharge hole is set to a position below an area A1 on the opposite side of the opening direction of the refrigerant discharge pipe from a line L1 passing an opening surface of the refrigerant discharge pipe and perpendicular to the opening direction of the refrigerant discharge pipe. Accordingly, the oil inside the refrigerant gas compressed by the rotary compression element, discharged from the discharge hole, and moving upward inside the sealed container is difficult to flow into the opening of the refrigerant discharge pipe inserted to the upper side of the driving element.

Accordingly, since the amount of the oil discharged to the outside of the sealed container may be reduced without drawing the front end of the refrigerant discharge pipe, the manufacturing cost may be remarkably reduced.

In particular, in the second aspect of the invention, when a range where oil inside the refrigerant discharged from the discharge hole and moving upward through the driving element flies or adheres to an inner surface of an end cap of the sealed container due to the inertia accompanying the rotation of the rotary compression element is denoted by A2, the position of the discharge hole is set to a position below the area A of a portion excluding the range A2 from the line L1 of a portion perpendicular to the opening direction of the refrigerant discharge pipe at the opposite side of the rotation direction of the rotary shaft. Accordingly, the oil inside the refrigerant gas flying in the rotation direction due to the inertia accompanying the rotation of the rotary compression element may be further reliably prevented from flowing from the opening of the refrigerant discharge pipe thereinto.

On the other hand, according to the third aspect of the invention, there is provided a rotary compressor including: a driving element which is provided inside a sealed container; and a rotary compression element which is provided inside the sealed container so as to be located below the driving element and to be driven by a rotary shaft of the driving element, wherein a refrigerant discharge pipe is inserted from a side surface of the sealed container above the driving element into the sealed container, and is opened in the horizontal direction, wherein a refrigerant compressed by the rotary compression element is discharged from a discharge hole into the sealed container, and is discharged from the refrigerant discharge pipe to the outside of the sealed container, and wherein the position of the discharge hole is set to a position below an area A3 interposed between a line L2 passing an opening surface of the refrigerant discharge pipe and perpendicular to the opening direction of the refrigerant discharge pipe at the opposite side of the rotation direction of the rotary shaft and a line L3 obtained by rotating the line L2 about the opening center of the refrigerant discharge pipe by 90° in the rotation direction of the rotary shaft. Accordingly, the amount of the oil discharged to the outside of the sealed container may be easily and more reliably reduced compared to the first aspect without measuring the flying range in advance like the second aspect.

In this case, as in the fourth aspect of the invention, when the opening center of the refrigerant discharge pipe is located at the center portion in the horizontal direction of the sealed container where the axis of the rotary shaft is located, the amount of oil discharged to the outside of the sealed container may be further reduced. Then, the above-described configuration is specifically effective when a so-called internal high-pressure-type two-stage compressing rotary compressor of the fifth aspect is used and carbon dioxide is used as the refrigerant as in the sixth aspect.

DETAILED DESCRIPTION OF THE PREFERRED EMBODIMENT

Figure 1:
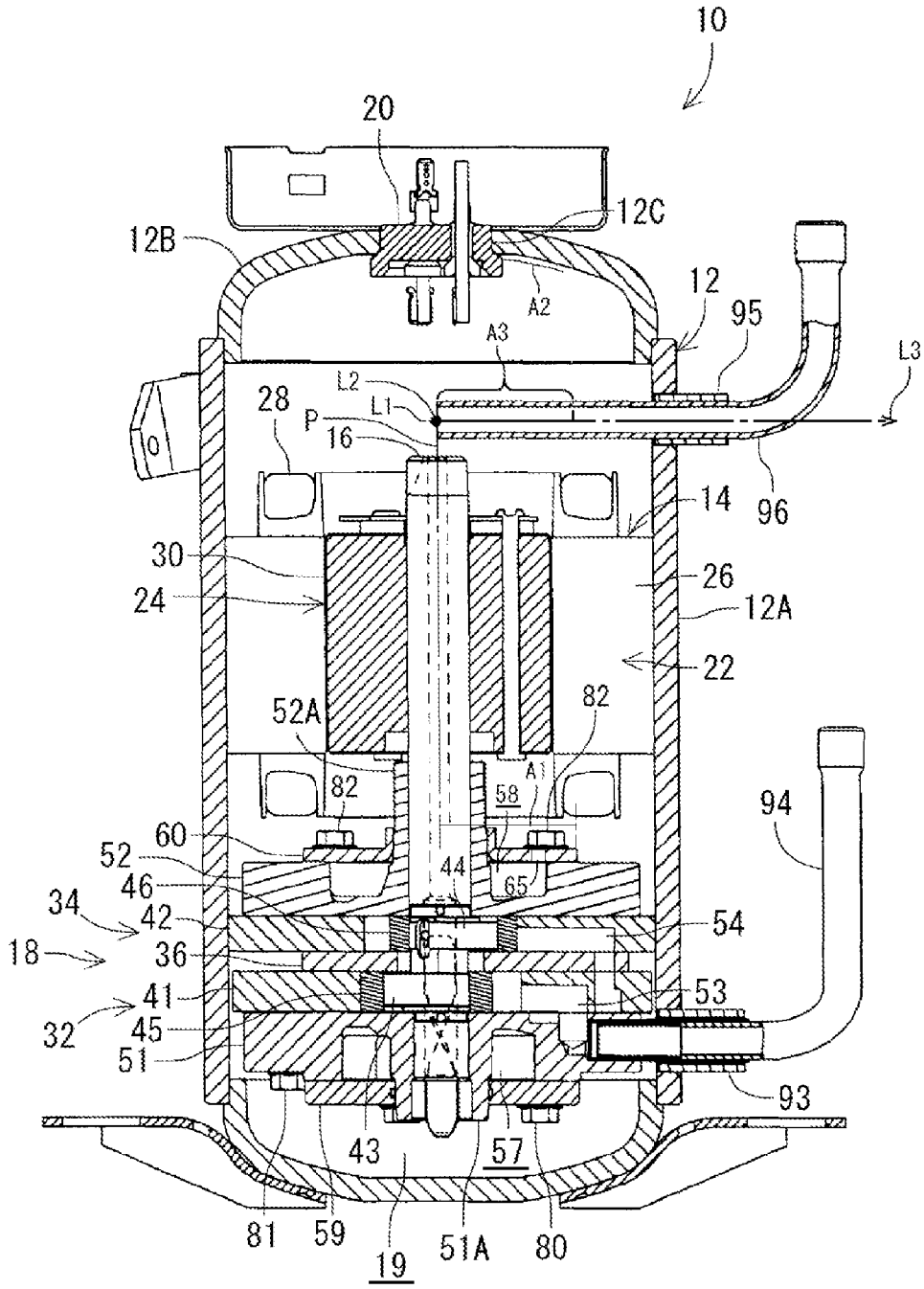
FIG. 1 is a side longitudinal sectional view illustrating a rotary compressor according to an embodiment of the invention (First Embodiment).

Hereinafter, preferred embodiments of the invention will be described in detail by referring to the drawings.

(First Embodiment)

Figure 2:
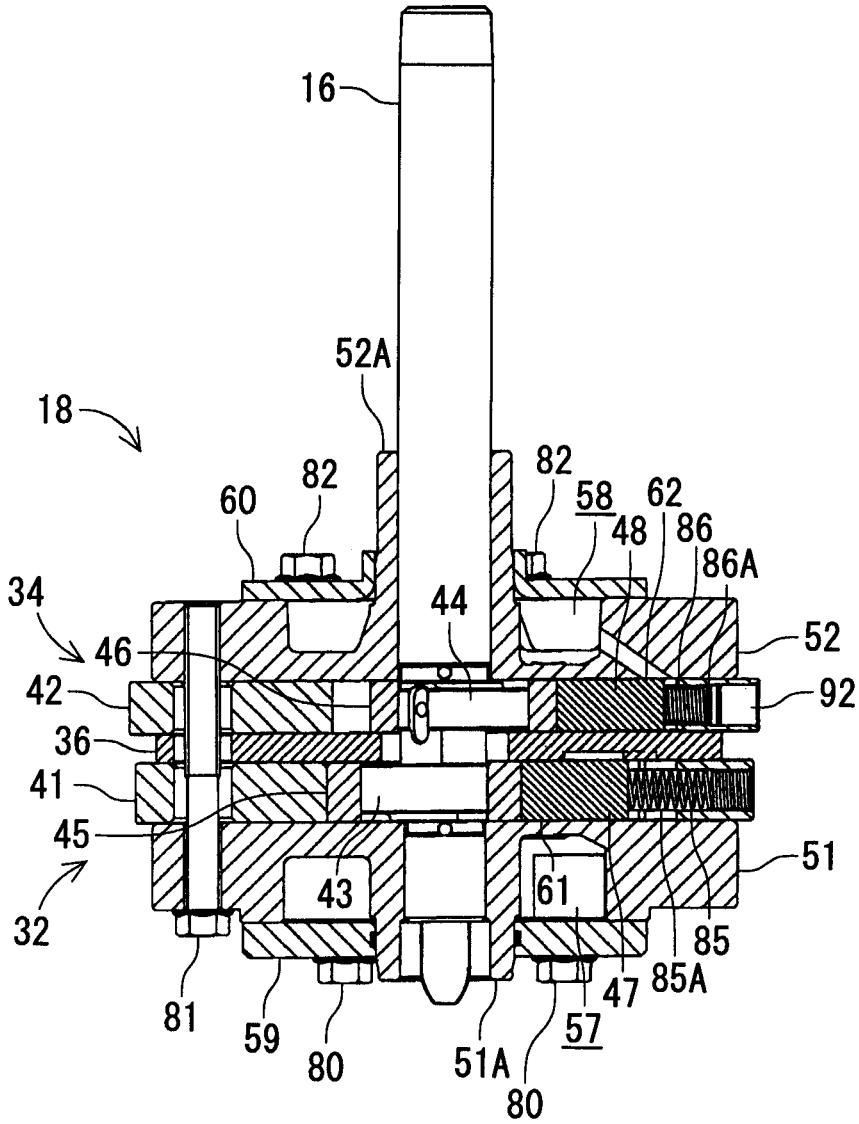
FIG. 2 is a side longitudinal sectional view illustrating a rotary compression element constituting the rotary compressor of FIG. 1.

In the embodiment, a rotary compressor will be described by using a so-called vertical rotary compressor of which an end cap side is disposed at an upper side, and a rotary compression element side is disposed at a lower side. FIG. 1 is a side longitudinal sectional view illustrating a rotary compressor according to an embodiment of the invention. FIG. 2 is a side longitudinal sectional view illustrating a rotary compression element constituting the rotary compressor of the invention.

A rotary compressor 10 shown in FIG. 1 includes a vertical cylindrical sealed container 12 which is made of a steel sheet, a driving element 14 which is disposed at an upper space inside the sealed container 12, and a rotary compression element 18 which has first and second rotary compression elements 32 and 34 which are disposed at a lower space of the driving element 14 and are driven by the rotary shaft 16 of the driving element 14. Then, the rotary compressor 10 is a so-called internal high-pressure-type multi-stage compressing compressor in which a refrigerant gas is compressed by the first rotary compression element 32, is further compressed by the second rotary compression element 34, and then is discharged into the sealed container 12.

The sealed container 12 includes a container body 12A which accommodates the driving element 14 and the rotary compression element 18, and a substantially bowl-shaped end cap 12B (a cover body) which blocks an upper opening of the container body 12A, where the bottom portion thereof is formed as a sump 19. A circular attachment hole 12C is formed at the upper surface of the end cap 12B, and a terminal 20 (where the interconnection thereof is not shown) is attached to the attachment hole 12C so as to supply power to the driving element 14.

The driving element 14 includes a stator 22 which is welded in an annular shape along the inner peripheral surface of the upper space of the sealed container 12, and a rotor 24 which is inserted into the stator 22 with a slight gap therebetween. The rotor 24 is fixed to a rotary shaft 16 that extends in the vertical direction along the center of the sealed container 12.

The stator 22 includes a laminated body 26 which is formed by stacking annular electromagnetic steel sheets, and a stator coil 28 which is directly wound (concentrically wound) on the tooth portion of the laminated body 26. Further, the rotor 24 includes a laminated body 30 which is formed by stacking electromagnetic sheets as in the stator 22.

The rotary compression element 18 has a structure in which the first and second rotary compression elements are disposed with an intermediate partition plate 36 interposed therebetween, the first rotary compression element 32 is disposed at the opposite side of the driving element 14 to perform a first-stage compression (in this case, the lower side of the rotary compressor 10), and the second rotary compression element 34 is disposed at the side of the driving element 14 inside the sealed container 12 to perform a second-stage compression (in this case, the upper side of the rotary compressor 10).

That is, as shown in FIG. 2, the rotary compression element 18 has a structure in which the first and second rotary compression elements are disposed with the intermediate partition plate 36 interposed therebetween, the second rotary compression element 34 as the second stage is disposed at the side of the driving element 14 inside the sealed container 12, and the first rotary compression element 32 as the first stage is disposed at the opposite side of the driving element 14. The first and second rotary compression elements 32 and 34 include: first and second cylinders (upper and lower cylinders) 41 and 42 which are disposed above and below the intermediate partition plate 36 and respectively constitute the first and second rotary compression elements 32 and 34; first and second rollers 45 and 46 which are respectively fitted to first and second eccentric portions 43 and 44 (upper and lower eccentric portions) formed on the rotary shaft 16 of the driving element 14 eccentrically and respectively rotating inside the cylinders 41 and 42; first and second vanes 47 and 48 (not shown in FIG. 1) which respectively come into contact with the rollers 45 and 46 and divide the interiors of the cylinders 41 and 42 into a low pressure side and a high pressure side; springs 85 and 86 which respectively serve as spring members biasing the vanes 47 and 48 toward the rollers 45 and 46 at all times; a first support member 51 (a lower support member) which serves as a support member blocking one (lower) opening of the first cylinder 41 (the lower cylinder) and has a bearing 51A of the rotary shaft 16, and a second support member 52 (an upper support member) which blocks an upper opening of the second cylinder 42 (the upper cylinder) and has a bearing 52A of the rotary shaft 16. That is, one (lower) opening of the first cylinder 41 constituting the first rotary compression element 32 is blocked by the first support member 51, and the other (upper) opening is blocked by the intermediate partition plate 36. Furthermore, the first and second eccentric portions 43 and 44 are respectively disposed on the rotary shaft 16 to have a difference in phase of 180°.

The first and second support members 51 and 52 are respectively provided with first and second suction passages 53 and 54 (only shown in FIG. 1) communicating the interiors of the first and second cylinders 41 and 42, a discharge muffling chamber 57 which is formed by recessing a (lower) surface opposite to the first cylinder 41 of the first support member 51 and blocking the recessed portion by a first cover 59 (a lower cover), and a discharge muffling chamber 58 which is formed by recessing a (upper) surface at the opposite side of the second cylinder 42 of the second support member 52 and blocking the recessed portion by a second cover 60 (an upper cover).

The second cover 60 is provided with a discharge hole 65 (shown only in FIG. 1) communicating with the discharge muffling chamber 58 and the interior of the sealed container 12. The discharge muffling chamber 58 is blocked by the second cover 60, and the discharge muffling chamber 57 is blocked by the first cover 59. Further, the bearing 52A uprightly formed at the center of the second support member 52, and the bearing 51A is perforated at the center of the first support member 51. Then, the second cover 60, the second support member 52, and the second cylinder 42 are positioned, four upper bolts 82 (only two of them is shown) are inserted from the second cover 60 (upper side) toward the first cover 59 (downward), and the bolts are threaded and fixed.

The first cover 59 is made of a donut-shaped circular steel sheet, and the four peripheral positions thereof are fixed to the second cylinder 42 by four bolts 80 (only two of them shown) inserted from the first cover 59 (lower side) toward the second cover 60 (upward), whereby the lower surface opening portion of the discharge muffling chamber 57 communicating with the interior of the first cylinder 41 constituting the first rotary compression element 32 is blocked. In addition, the first support member 51 is provided with two bolts 81 (only left one is shown), and the bolts 81 are threaded into the second support member 52, whereby the first support member 51 and the second support member 52 are integrally fixed.

The interior of the first cylinder 41 is provided with a first vane slot 61 which accommodates the first vane 47, and an accommodation portion 85A which accommodates the spring 85 as the spring member biasing the first vane 47 toward the first roller 45 at all times and located at the outside (the side of the sealed container 12) of the first vane slot 61, where the accommodation portion 85A is opened to the side of the first vane 47 and the side of the sealed container 12. The spring 85 comes into contact with the outer end portion of the first vane 47, whereby the first vane 47 is biased toward the first roller 45 at all times.

Further, the interior of the second cylinder 42 is also provided with a second vane slot 62 which accommodates the second vane 48, and an accommodation portion 86A which accommodates the spring 86 as the spring member biasing the second vane 48 toward the second roller 46 at all times and located at the outside (the side of the sealed container 12) of the second vane slot 62, where the accommodation portion 86A is opened to the side of the second vane 48 and the side of the sealed container 12. The spring 86 comes into contact with the outer end portion of the second vane 48, whereby the second vane 48 is biased toward the second roller 48 at all times.

Then, a metallic plug 92 is press-inserted into the accommodation portion 86A located at the side of the sealed container 12 of the spring 86 so as to prevent the spring 86 from coming off from the opening of the outside (the side of the sealed container 12) of the accommodation portion 86A. The outer diameter of the plug 92 is set to be slightly larger than the inner diameter of the accommodation portion 86A, and the plug 92 is press-inserted and fixed into the accommodation portion 86A. The plug 92 is provided with a communication portion (not shown) which prevents a jumping of the vane (the second vane 48), and the back pressure of the vane is used as the gas pressure (the high pressure) inside the sealed container 12 by the communication portion.

On the other hand, in the side surface of the container body 12A of the sealed container 12, sleeves 93 and 95 are welded to positions respectively corresponding to the upper side of the driving element 14 and the first suction passage 53 of the first cylinder 41 (shown in FIG. 1). The interior of the sleeve 93 is connected with one end of a refrigerant introduction pipe 94 that introduces a refrigerant gas into the first cylinder 41, and one end of the refrigerant introduction pipe 94 communicates with the first suction passage 53 of the first cylinder 41. Further, the refrigerant discharge pipe 96 is inserted and connected to the interior of the sleeve 95, the refrigerant discharge pipe 96 is located at the upper side of the driving element 14 (the side of the terminal 20 of the driving element 14), and the end portion thereof is opened to communicate with the interior of the sealed container 12.

Figure 3:
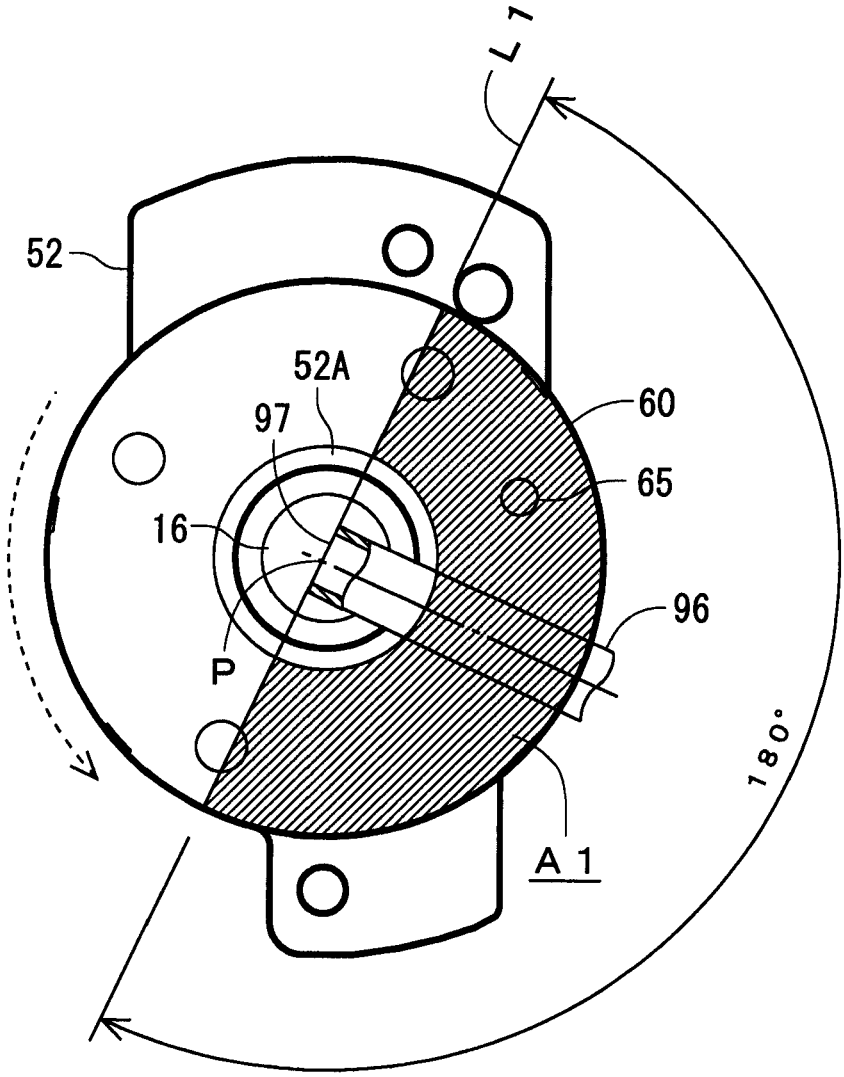
FIG. 3 is a schematic diagram illustrating a positional relationship between an opening of a refrigerant discharge pipe constituting the rotary compressor of the invention and a discharge hole formed in a second cover to communicate with the inside of a sealed container.

Then, as shown in FIG. 3, the refrigerant discharge pipe 96 is cut in the direction perpendicular to the length direction of the refrigerant discharge pipe 96, so that the end portion is opened. The refrigerant discharge pipe 96 is inserted from the side surface of the sealed container 12 above the driving element 14 into the sealed container 12, and is opened in the horizontal direction (the direction perpendicular to the length direction of the vertical cylindrical sealed container 12) at the center portion P (which is the same as the position of the axis of the rotary shaft 16). Specifically, the opening center of the refrigerant discharge pipe 96 is located at the center portion P in the horizontal direction of the sealed container 12, the end portion of the refrigerant discharge pipe 96 is opened in the horizontal direction therefrom, and the end portion opening is formed as an opening surface 97. Furthermore, FIG. 3 is a schematic diagram illustrating a positional relationship between the discharge hole 65 communicating with the interior of the sealed container 12 and formed in the second cover 60 and the opening surface 97 of the refrigerant discharge pipe 96.

Here, as a result of a test in which the end cap 12B was formed of a transparent resin and pseudo flowing (floating) oil (steam or the like) was discharged from the discharge hole 65 to adhere to the end cap 12B, the following result was obtained. It was proved that the oil moving upward together with the refrigerant directly and easily entered from the opening into the refrigerant discharge pipe 96 when the discharge hole 65 was located at the lower side in the opening direction of the refrigerant discharge pipe 96 (for example, the opening direction side of the range of 120°). Further, as a result of another test, it was proved that the oil was most difficult to exit the refrigerant discharge pipe 96 when the opening of the refrigerant discharge pipe 96 was aligned with the center portion P of the sealed container 12.

Then, the discharge hole 65 formed in the second cover 60 is located below the area A1 (at the side of the rotary compression element 18) on the opposite side of the opening direction of the refrigerant discharge pipe 96 from the line L1 perpendicular to the opening direction of the refrigerant discharge pipe 96 and passing the opening surface 97 of the refrigerant discharge pipe 96. Specifically, the discharge hole 65 formed in the second cover 60 is located below (at the lower side of the sealed container 12) the range depicted by the arrow (the portion depicted by the slanted line) of 180° at the side of the refrigerant discharge pipe 96 with respect to the opening surface 97 of the refrigerant discharge pipe 96. In this case, the positional relationship between the discharge hole 65 and the oil adhered portion was obtained in advance through a test in which the end cap 12B was formed of a transparent resin and pseudo flowing (floating) oil (steam or the like) was discharged from the discharge hole 65 to adhere to the end cap 12B.

That is, a range is obtained in which the oil inside the refrigerant gas discharged from the discharge hole 65 and moving upward through the driving element 14 flies or adheres to the inner surface of the end cap 12B of the sealed container 12 due to the inertia accompanying the rotation of the rotary compression element 18. Therefore, the opening surface 97 of the refrigerant discharge pipe 96 is directed to the direction in which the amount of the flowing (floating) oil is small, and the end portion of the refrigerant discharge pipe 96 is opened to a position where the amount of the flowing (floating) oil inside the sealed container 12 is small.

Next, the operation of the rotary compressor 10 with the above-described configuration will be described. Furthermore, as the refrigerant enclosed in the refrigerant circuit of the rotary compressor 10, carbon dioxide ($CO_2$) which is an earth-friendly and natural refrigerant is used. Then, when power is supplied to the stator coil 28 of the driving element 14 via the terminal 20 and the interconnection (not shown), the driving element 14 is activated, so that the rotor 24 rotates in the counter-clockwise direction (the direction depicted by the dotted arrow of FIG. 3). In accordance with the rotation of the rotor 24, the first and second rollers 45 and 46 fitted to the first and second eccentric portions 43 and 44 integrally formed with the rotary shaft 16 eccentrically rotate inside the cylinders 41 and 42.

Accordingly, a low-pressure refrigerant gas is suctioned to the low pressure side of the first cylinder 41 through the refrigerant introduction pipe 94 and the first suction passage 53 formed in the first support member 51. The low-pressure refrigerant gas suctioned to the low pressure side of the first cylinder 41 is subjected to a first-stage compression by the action of the first roller 45 and the first vane 47 to receive a medium pressure, and is discharged from the high pressure side of the first cylinder 41 into the discharge muffling chamber 57 through a discharge port.

The medium-pressure refrigerant gas discharged to the discharge muffling chamber 57 is suctioned from the interior of the discharge muffling chamber 57 to the low pressure side of the second cylinder 42 through the second suction passage 54 formed in the lower surface of the second cylinder 42. Then, the medium-pressure refrigerant gas suctioned to the low pressure side inside the second cylinder 42 is subjected to a second-stage compression by the action of the second roller 46 and the second vane 48 to become a high-temperature and high-pressure refrigerant gas, and is discharged from the high pressure side of the second cylinder 42 to the second support member 52 and the discharge muffling chamber 58 formed in the second cover 60 through the discharge port (not shown).

The refrigerant gas discharged to the discharge muffling chamber 57 is discharged into the sealed container 12 through the discharge hole 65 formed in the second cover 60. The refrigerant gas with oil dissolved therein discharged into the sealed container 12 from the discharge hole 65 flies in the rotation direction of the rotary shaft 16 due to the inertia accompanying the rotation of the driving element 14, moves upward through a gap between the stator 22 and the rotor 24 of the driving element 14, the interior of the rotor 24, or a gap between the sealed container 12 and the stator 22, moves to the upper side of the driving element 14 (the upper side inside the sealed container 12 (the space between the end cap 12B and the driving element 14)), and is discharged from the opening of the refrigerant discharge pipe 96 connected to the upper side of the sealed container 12 to the outside of the rotary compressor 10 through the interior of the refrigerant discharge pipe 96.

At this time, the refrigerant gas containing the oil moves upward in the direction of the refrigerant discharge pipe 96 from a gap between the slot and the coil of the stator coil 28 or a gap between the hub of the stator coil 28 and the rotor 24. That is, in the refrigerant gas moving to the upper side of the sealed container 12 through a gap in the driving element 14, the oil flowing (in a floating state) inside the sealed container 12 together with the refrigerant gas moves upward, and is discharged from the refrigerant discharge pipe 96. However, in the invention, as described above, the opening surface 97 of the refrigerant discharge pipe 96 is directed to the direction in which the amount of flowing (floating) oil inside the sealed container 12 is small, and the end portion of the refrigerant discharge pipe 96 is opened to the position where the amount of flowing (floating) oil is small inside the sealed container 12. Accordingly, it is possible to remarkably prevent the oil from being discharged from the refrigerant discharge pipe 96 to the outside of the rotary compressor 10.

As described above in detail, the position of the discharge hole 65 formed in the second cover 60 is set to a position below the area A1 on the opposite side of the opening direction of the refrigerant discharge pipe 96 from the line L1 perpendicular to the opening direction of the refrigerant discharge pipe 96 and passing the opening surface 97 of the refrigerant discharge pipe 96. Accordingly, the oil inside the refrigerant gas compressed by the rotary compression element 18, discharged from the discharge hole 65, and moving upward inside the sealed container 12 is difficult to flow into the opening of the refrigerant discharge pipe 96 inserted to the upper side of the driving element 14.

Accordingly, since the amount of the oil discharged to the outside of the sealed container 12 may be reduced without drawing the front end of the refrigerant discharge pipe 96 as in the related art, the manufacturing cost may be remarkably reduced.

(Second Embodiment)

Figure 4:
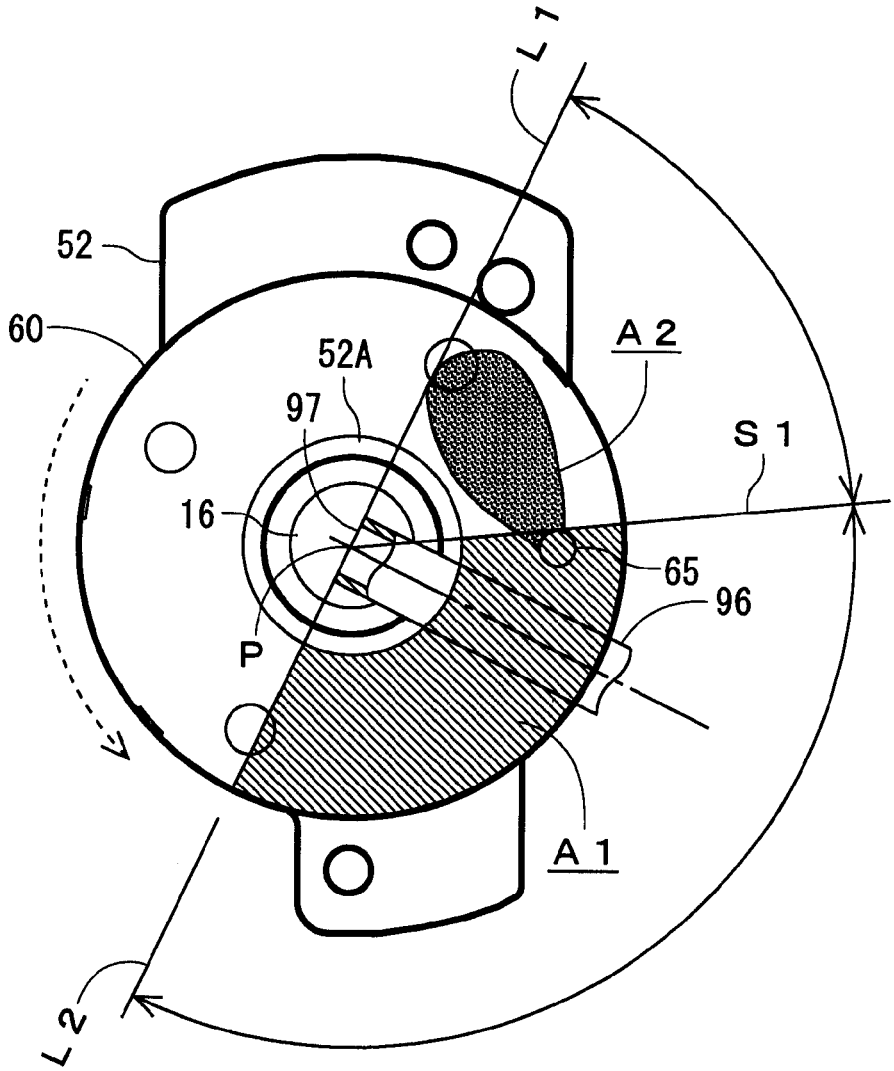
FIG. 4 is a schematic diagram illustrating a positional relationship between a discharge hole formed in a sealed container of a second cover to communicate with the inside of the sealed container and an opening of a refrigerant discharge pipe constituting the rotary compressor according to an embodiment of the invention (Second Embodiment).

Next, FIG. 4 is a schematic diagram illustrating a positional relationship between the discharge hole 65 communicating with the interior of the sealed container 12 and formed in the second cover 60 and the opening of the refrigerant discharge pipe 96 constituting the rotary compressor 10 according to another embodiment of the invention. The rotary compressor 10 has substantially the same configuration at that of the above-described embodiment. Hereinafter, the different points will be described. Furthermore, the same reference numerals are given to the same elements as those of the above-described embodiment, and the description thereof will be omitted. Further, the direction depicted by the dotted arrow indicates the rotation direction of the rotary shaft 16.

Regarding the discharge hole 65 formed in the second cover 60, as shown in FIG. 4, when the range where the oil inside the refrigerant gas discharged from the discharge hole 65 and moving upward through the driving element 14 flies or adheres to the inner surface of the end cap 12B of the sealed container 12 due to the inertia accompanying the rotation of the rotary compression element 18 is denoted by A2, the position of the discharge hole 65 is set to a position below the area A1 excluding the range A2 from the line L1 of a portion perpendicular to the opening direction of the refrigerant discharge pipe 96 at the opposite side of the rotation direction of the rotary shaft 16.

Even in this case, the positional relationship between the discharge hole 65 and the oil adhered portion was obtained in advance through a test in which the end cap 12B was formed of a transparent resin and pseudo flowing (floating) oil (steam or the like) was discharged from the discharge hole 65 to adhere to the end cap 12B. Then, the opening surface 97 of the refrigerant discharge pipe 96 is directed to the direction in which the amount of the pseudo flowing (floating) oil adhering to the end cap 12B is small, and the end portion of the refrigerant discharge pipe 96 is opened to the position where the amount of the flowing (floating) oil is small inside the sealed container 12. Then, the range from the center portion P of the horizontal direction of the sealed container 12 to the radiation line S1 passing the discharge hole 65, that is, the area A1 (the portion depicted by the slanted line of FIG. 4) excluding the range (the solid arrow) from the line L1 to the line S1 from the portion depicted by the slanted line of A1 of the first embodiment is set, and the position of the discharge hole 65 is set at the lower side of the area A1 (the side of the rotary compression element 18). Accordingly, the oil inside the refrigerant gas flying in the sealed container 12 may be prevented from flowing into the opening of the refrigerant discharge pipe 96.

Likewise, when the range where the oil inside the refrigerant gas discharged from the discharge hole 65 and moving upward through the driving element 14 flies or adheres to the inner surface of the end cap 12B of the sealed container 12 due to the inertia accompanying the rotation of the rotary compression element 18 is denoted by A2, the position of the discharge hole 65 is set to a position below the area A1 excluding the range A2 from the line L1 of a portion perpendicular to the opening direction of the refrigerant discharge pipe 96 at the opposite side of the rotation direction of the rotary shaft 16. Accordingly, the oil inside the refrigerant gas flying in the rotation direction due to the inertia accompanying the rotation of the rotary compression element 18 may be further reliably prevented from flowing from the opening of the refrigerant discharge pipe 96 thereinto.

(Third Embodiment)

Figure 5:
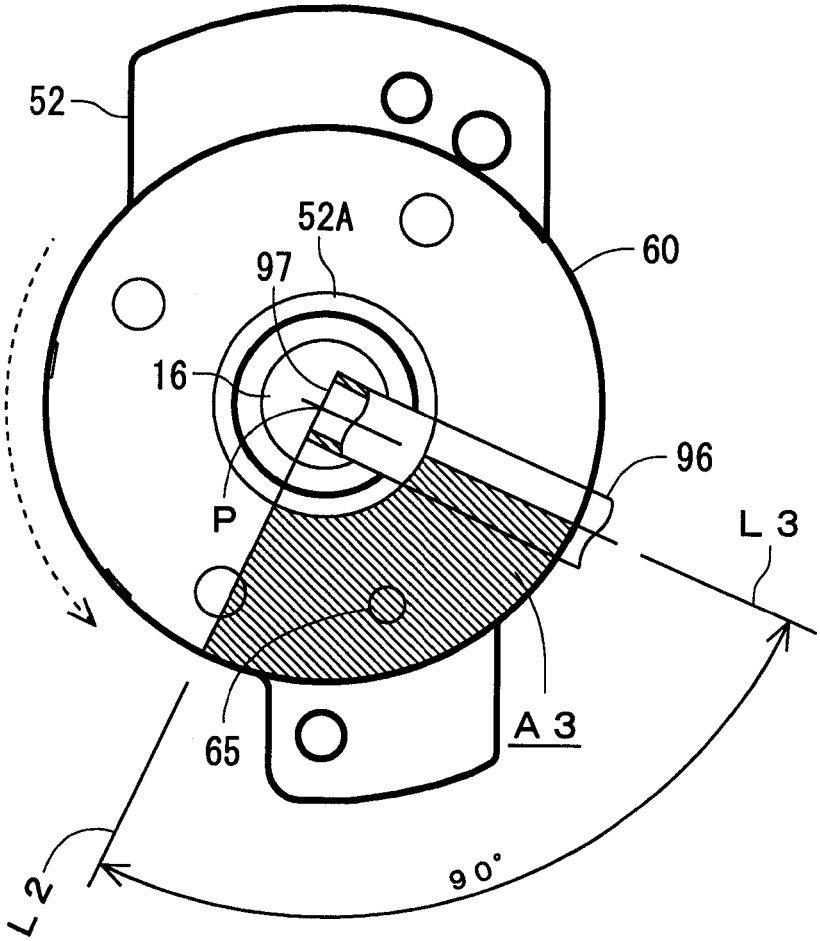
FIG. 5 is a schematic diagram illustrating a positional relationship between a discharge hole formed in a sealed container of a second cover to communicate with the inside of the sealed container and an opening of a refrigerant discharge pipe constituting the rotary compressor according to an embodiment of the invention (Third Embodiment)
Figure 6:
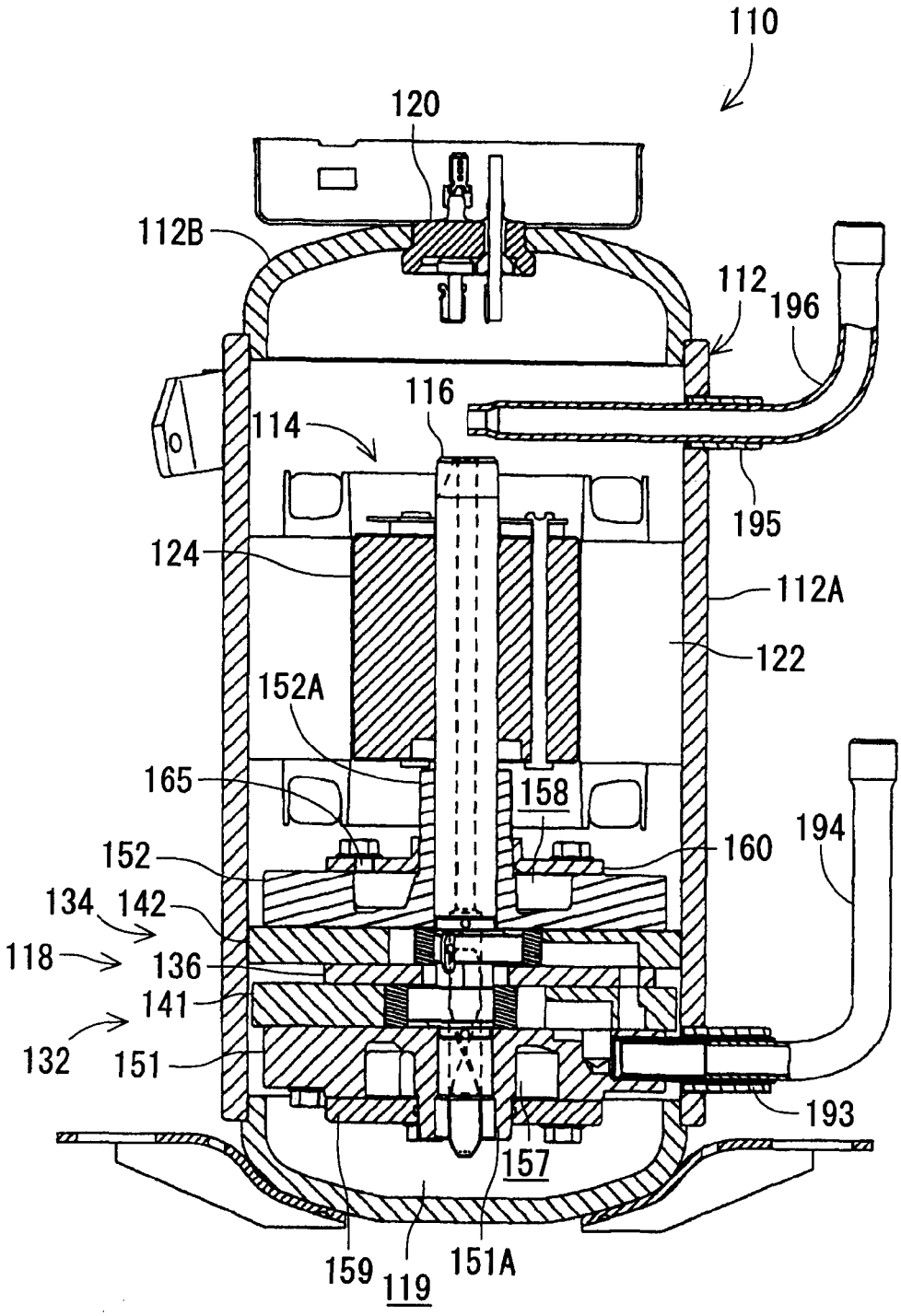
FIG. 6 PRIOR ART
FIG. 6 is a side longitudinal sectional view illustrating an existing rotary compressor.
Figure 7:
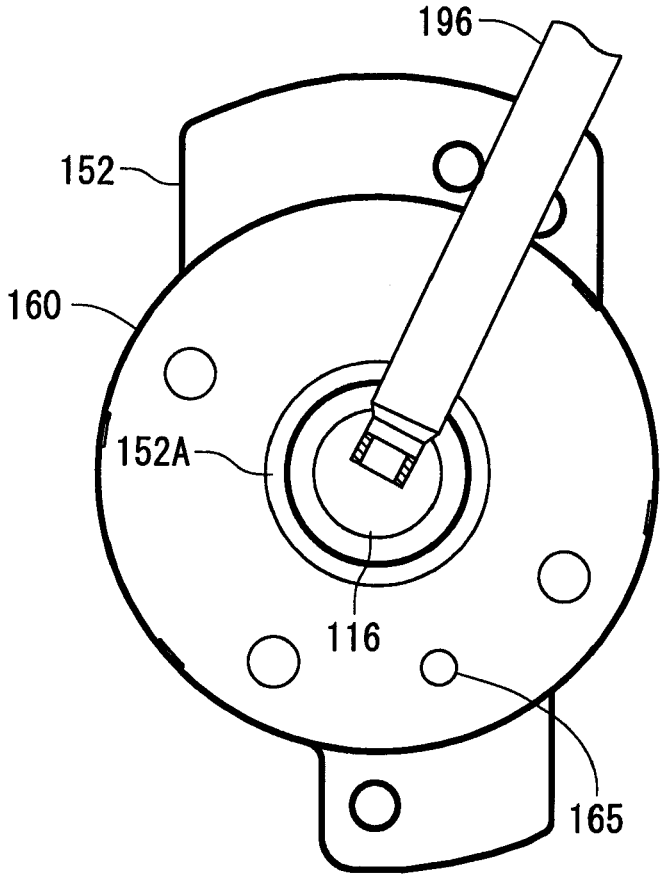
FIG. 7 PRIOR ART
FIG. 7 is a schematic diagram illustrating a positional relationship between a refrigerant discharge pipe and a discharge pipe of FIG. 6.

Next, FIG. 5 is a schematic diagram illustrating a positional relationship between the discharge hole 65 communicating with the interior of the sealed container 12 and formed in the second cover 60 and the opening of the refrigerant discharge pipe 96 constituting the rotary compressor 10 according to another embodiment of the invention. The rotary compressor 10 has substantially the same configuration at that of the above-described embodiment. Hereinafter, the different points will be described. Furthermore, the same reference numerals are given to the same elements as those of the above-described embodiment, and the description thereof will be omitted. Further, the direction depicted by the dotted arrow indicates the rotation direction of the rotary shaft 16. Further, in the general rotary compressor, the range where the pseudo flowing (floating) oil discharged from the discharge hole 65 adheres to the end cap 12B is known from the above-described embodiments. Accordingly, in the third embodiment, a test may not be performed in which the end cap 12B is formed of a transparent resin and the flowing (floating) oil adheres to the inner surface of the sealed container 12 so as to obtain the positional relationship between the discharge hole 65 and the oil adhered portion.

In the discharge hole 65 formed in the second cover 60, as shown in FIG. 5, the position of the discharge hole 65 is set to the lower side (the side of the rotary compression element 18) of the area A3 (the portion depicted by the slanted line of FIG. 5) interposed between the line L2 passing the opening surface 97 of the refrigerant discharge pipe 96 and perpendicular to the opening direction of the refrigerant discharge pipe 96 at the side of the rotation direction of the rotary shaft 16 (in this case, the extension line of the rotation direction of the rotary shaft 16 in the extension line of the opening surface 97 of the refrigerant discharge pipe 96) and the line L3 obtained by rotating the line L2 about the opening center P of the refrigerant discharge pipe 96 by 90° in the rotation direction of the rotary shaft 16.

Likewise, when the position of the discharge hole 65 formed in the second cover 60 is set to a position below the area A3 interposed between the line L2 passing the opening surface 97 of the refrigerant discharge pipe 96 and perpendicular to the opening direction of the refrigerant discharge pipe 96 at the side of the rotation direction of the rotary shaft 16 and the line L3 obtained by rotating the line L2 about the opening center P of the refrigerant discharge pipe 96 by 90° in the rotation direction of the rotary shaft 16, the amount of the oil discharged to the outside of the sealed container 12 may be easily and more reliably reduced compared to the first invention without measuring the flying range in advance like the second invention.

While the preferred embodiments of the invention have been described, the invention is not limited thereto. Further, for example, the invention is applied to the rotary compressor 10 using carbon dioxide as a refrigerant, but may be applied to a rotary compressor using a highly compressed refrigerant (for example, a nitrogen gas or the like) except for carbon dioxide or a piston type compressor.

Further, in the above-described embodiments, the position of the discharge hole 65 is set on the basis of the opening surface 97 of the refrigerant discharge pipe 96, but the opening surface 97 of the refrigerant discharge pipe 96 may be set on the basis of the position of the discharge hole 65. Further, the rotary compressor 10 is described to perform a two-stage compression, but the invention may be applied to a single-stage compression. Of course, the invention is not limited to have the pipe configuration of the like shown in the above-described embodiments, and may be modified in various forms within the scope not departing from the spirit of the invention.

What is claimed is:

1. A rotary compressor comprising:

a sealed container, a driving element which is provided inside the sealed container, the driving element including a rotary shaft having an axis; and a rotary compression element which is provided inside the sealed container below the driving element, the rotary compression element being driven by the rotary shaft of the driving element, a refrigerant discharge pipe inserted from a side surface of the sealed container above the driving element into the sealed container, the refrigerant discharge pipe having an opening in the horizontal direction, a cover which is provided inside the sealed container between the driving element and the rotary compression element, wherein a refrigerant compressed by the rotary compression element is discharged from the discharge hole into the sealed container, and is discharged from the refrigerant discharge pipe to the outside of the sealed container, wherein a vertical plane defined by the axis of the rotary shaft and a line L1 passing the surface of the opening of the refrigerant discharge pipe and perpendicular to the direction of the opening of the refrigerant discharge pipe divides the sealed container into a first half on the opposite side of the direction of the opening of the refrigerant discharge pipe from the line L1 and a second half, the refrigerant discharge pipe is positioned in the first half of the sealed container, and a planar area A1 is defined in the first half above the cover, and wherein the position of the discharge hole is set to a position in the cover below the area A1 on the opposite side of the direction of the opening of the refrigerant discharge pipe from the line L1.

2. The rotary compressor according to claim 1, wherein the sealed container includes an end cap above the opening of the refrigerant discharge pipe, and wherein a range A2 is defined where oil inside the refrigerant discharged from the discharge hole and moving upward through the driving element flies or adheres to an inner surface of the end cap of the sealed container due to the inertia accompanying the rotation of the rotary compression element, and wherein the position of the discharge hole is set to a position in a portion of the cover below the area A1 excluding a projection onto the cover of the range A2 from the line L1.

3. The rotary compressor according to claim 2, wherein the center of the opening of the refrigerant discharge pipe is located at the center portion in the horizontal direction of the sealed container where the axis of the rotary shaft is located.

4. The rotary compressor according to claim 3, wherein the rotary compression element is a first rotary compression element and the rotary compressor further comprises:

a second rotary compression element driven by the rotary shaft of the driving element, wherein the refrigerant compressed by the first rotary compression element is compressed by the second rotary compression element, and is discharged from the discharge hole to the sealed container.

5. The rotary compressor according to claim 4, wherein carbon dioxide is used as the refrigerant.

6. The rotary compressor according to claim 1, wherein the center of the opening of the refrigerant discharge pipe is located at the center portion in the horizontal direction of the sealed container where the axis of the rotary shaft is located.

7. The rotary compressor according to claim 6, wherein the rotary compression element comprises first and second rotary compression elements which are driven by the rotary shaft of the driving element, and wherein the refrigerant compressed by the first rotary compression element is compressed by the second rotary compression element, and is discharged from the discharge hole to the sealed container.

8. The rotary compressor according to claim 7, wherein carbon dioxide is used as the refrigerant.

9. A rotary compressor comprising:

a sealed container, a driving element which is provided inside the sealed container, the driving element including a rotary shaft having an axis and a rotation direction; and a rotary compression element which is provided inside the sealed container below the driving element, the rotary compression element being driven by the rotary shaft of the driving element, a refrigerant discharge pipe is inserted from a side surface of the sealed container above the driving element into the sealed container, the refrigerant discharge pipe having an opening in the horizontal direction, a cover which is provided inside the sealed container between the driving element and the rotary compression element, wherein a refrigerant compressed by the rotary compression element is discharged from a discharge hole into the sealed container, and is discharged from the refrigerant discharge pipe to the outside of the sealed container, and wherein a planar area A3 is defined between a line segment L2 and a line segment L3, where the line segment L2 extends radially from the axis of the rotary shaft at the center of the opening of the refrigerant discharge pipe, passing the surface of the opening of the refrigerant discharge pipe and perpendicular to the direction of the opening of the refrigerant discharge pipe at the side of the rotation direction of the rotary shaft and the line segment L3 extending radially from the opening center of the refrigerant discharge pipe at an angle of 90° from the line segment L2 in the rotation direction of the rotary shaft, and wherein the position of the discharge hole is set to a position in the cover below the area A3.

10. The rotary compressor according to claim 9, wherein the center of the opening of the refrigerant discharge pipe is located at the center portion in the horizontal direction of the sealed container where the axis of the rotary shaft is located.

11. The rotary compressor according to claim 10, wherein the rotary compression element is a first rotary compression element and the rotary compressor further comprises:

a second rotary compression element driven by the rotary shaft of the driving element, wherein the refrigerant compressed by the first rotary compression element is compressed by the second rotary compression element, and is discharged from the discharge hole to the sealed container.

12. The rotary compressor according to claim 11, wherein carbon dioxide is used as the refrigerant.

* * * * *